US006688135B1

(12) United States Patent
Mattia et al.

(10) Patent No.: US 6,688,135 B1
(45) Date of Patent: Feb. 10, 2004

(54) COOL INSERT

(76) Inventors: Steve Mattia, 3300 Ridge La., Boca Raton, FL (US) 33435; Mark Krejcarek, 3915 Curtis Cir., Boca Raton, FL (US) 33434; Jonathan Boyle, 5979 Michaux St., Boca Raton, FL (US) 33433

( * ) Notice: Subject to any disclaimer, the term of this patent is extended or adjusted under 35 U.S.C. 154(b) by 0 days.

(21) Appl. No.: 10/325,113

(22) Filed: Dec. 20, 2002

(51) Int. Cl.[7] ..... F25D 3/08
(52) U.S. Cl. ..... 62/457.1; 62/457.2; 62/457.4
(58) Field of Search ..... 62/457.1, 457.2, 62/457.4, 371, 372, 529; 165/80.5

(56) References Cited

U.S. PATENT DOCUMENTS 4,939,912 A * 7/1990 Leonovich, Jr. ..... 62/457.1
5,437,395 A * 8/1995 Bull et al. ..... 222/129.1
5,456,090 A * 10/1995 McCoy ..... 62/372
5,520,014 A * 5/1996 Laugier ..... 62/457.2
5,689,970 A * 11/1997 Chopas ..... 62/372
5,996,842 A * 12/1999 Riley et al. ..... 222/1
6,102,246 A * 8/2000 Goulet et al. ..... 221/11
6,151,910 A * 11/2000 Hazen ..... 62/457.2
6,421,240 B1 * 7/2002 Patel ..... 361/699

FOREIGN PATENT DOCUMENTS

EP 2232480 A * 12/1990

* cited by examiner

*Primary Examiner*—William E. Tapolcai
*Assistant Examiner*—Mohammad M. Ali
(74) *Attorney, Agent, or Firm*—Michael J. DeLuca; Fleit, Kain, Gibbons, Gutman, Bongini & Bianco P.L.

(57) ABSTRACT

An insert is retained at the bottom of a portable liquid drink dispenser close to its nozzle. The insert has an inclined top surface for eliminating the need to tip the drink dispenser in order to dispense the final drinks. The insert has a coolant for cooling the fluid at the bottom of the drink dispenser in the area of the nozzle. The coolant may be water, gel or other high heat density material. The insert is chilled in a freezer prior to being retained in the drink dispenser. The insert is removably retained in the bottom of the drink dispenser using any or all of several retention means. The insert has the further advantage of allowing for the stacking of inserts during freezing and transport. Elimination of the need for tipping the drink dispenser allows for the stacking or mounting of drink dispensers while dispensing drinks.

14 Claims, 4 Drawing Sheets

COOL INSERT

FIELD OF THE INVENTION

This invention is related to the area of portable liquid dispensers and the heating or cooling thereof.

BACKGROUND OF THE INVENTION

Portable liquid dispensers, such as drink dispensers or sports coolers are used in a number of applications including sporting events, construction sites and other areas where drinking fluids provide relief from physical activity. Such dispensers can be found on sidelines of sporting events or rigidly mounted to the back of trucks or other heavy equipment around construction or other labor sites. Such dispensers are typically round and have a nozzle at the bottom of a side wall for dispensing up to five or ten or more gallons of refreshing drink such as Gatorade or other fluid.

Such dispensers have several disadvantages. In order to provide for a cool drink, ice is added to the fluid. Since ice floats to the top, the fluid at the bottom of the container is not well cooled. Furthermore, as the ice melts, the fluid is diluted thereby changing the flavor and reducing any medicinal effect resulting from the drink. Furthermore, it is often necessary to tip the dispenser in order to dispense the last of the remaining fluid from the nozzle of the dispenser. The requirement of tipping the dispenser makes it impractical to stack or rigidly mount liquid dispensers. Thus, what is needed is a solution to the aforementioned problems.

DETAILED DESCRIPTION OF THE INVENTION

Figure 1:
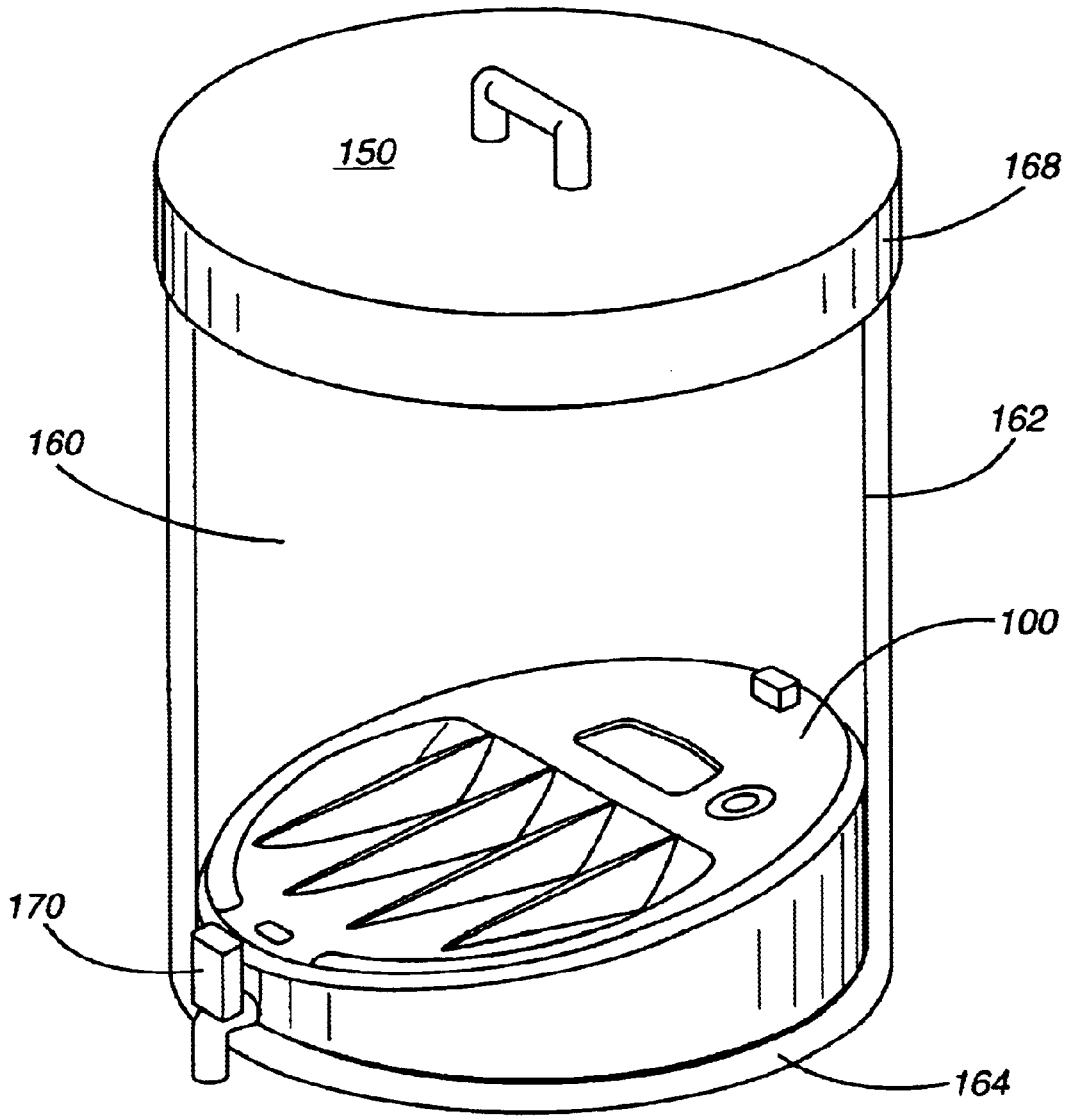
FIG. 1 shows a removable cool insert retained within a liquid dispenser.

FIG. 1 shows a removable cool insert 100 retained within a liquid dispenser 150. The liquid dispenser has an insulated interior chamber 160 formed by interior cylindrical side walls 162 and a bottom surface 164. A removable top 168 includes an optional fold-down handle and facilitates removal and insertion of the cool insert 100 as well as the fluid. Top 168 also completes insulation of the interior chamber 160 and facilitates stacking of multiple liquid dispensers. Dispenser 150 also includes a nozzle 170 located substantially at its bottom for dispensing fluid contained within the interior chamber 160.

The insert 100 is preferably molded of a plastic or fashioned from other material facilitating heat transfer, such materials are known to those familiar with the art. In the preferred embodiment, insert 100 is pre-frozen, inserted and retained at the bottom of the dispenser 150. Thus, the insert cools the fluid at the bottom of the dispenser. Since cooled fluids tend to remain at the bottom of the dispenser and warmer fluids tend to rise towards the top of the dispenser, the cool insert 100 has the advantage in that the fluid dispensed at the nozzle 170 tends to be the coolest fluids within the interior chamber of the dispenser.

Figure 2:
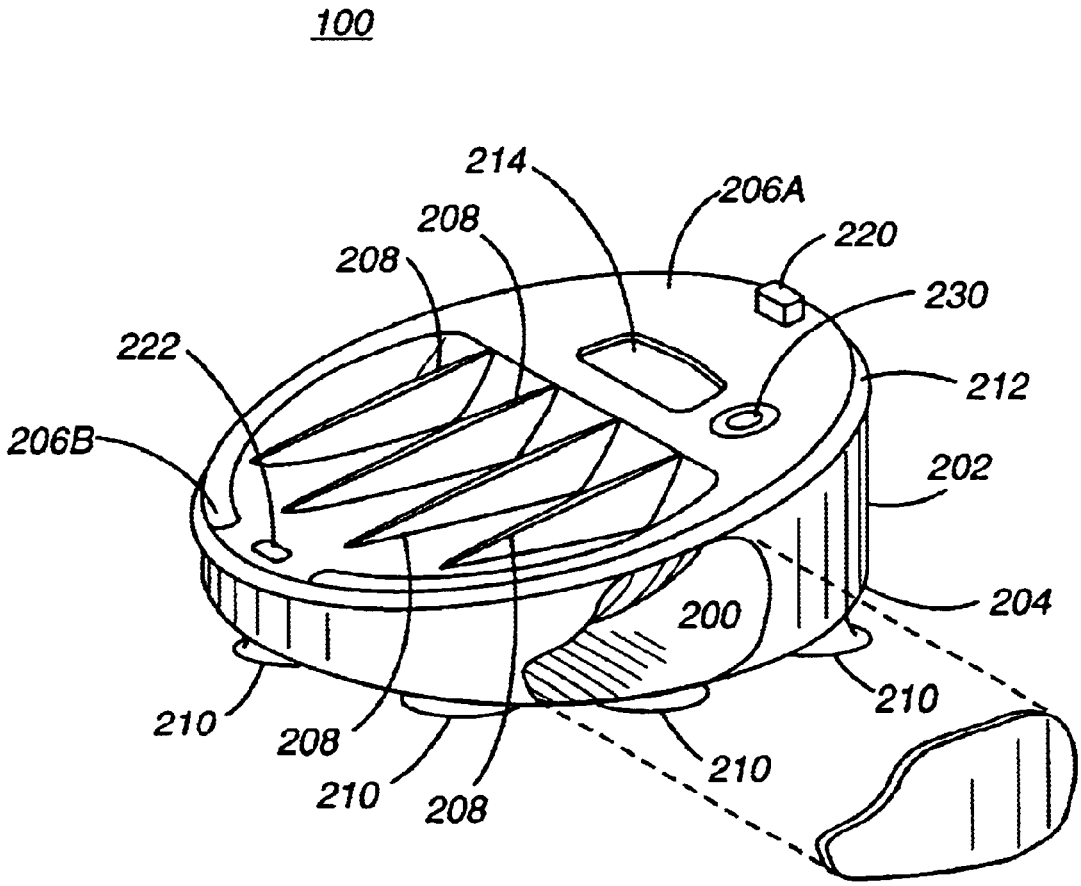
FIG. 2 shows a detailed breakaway perspective of the cool insert.

FIG. 2 shows a detailed breakaway perspective of the cool insert. The insert 100 has an interior 200 which includes a heat storage means for substantially modifying or maintaining the temperature of a fluid contained within the liquid dispenser relative to an ambient temperature exterior to the drink dispenser. The heat storage means includes a refrigerant such as water/ice or a gel-pack for storing heat. Other heat storage means known to those familiar with the art for facilitating the transfer of heat between the insert and the fluid are anticipated. The preferred embodiment discloses cooling the fluid by transferring heat from the fluid to the insert, thereby cooling the fluid. In an alternate embodiment, the opposite form of heat transfer is also anticipated. In the alternate embodiment, the insert 100 can heat the fluid.

The interior 200 may optionally include a weight for increasing the density of the insert beyond the density of the fluid stored in the dispenser 150 thereby facilitating the sinking of the insert to the bottom of the dispenser. The weight serves as a retainer for retaining the insert at the bottom of the dispenser chamber while facilitating its removal.

The insert includes cylindrical side walls 202, a bottom 204, and a top inclined surface 206. Referring back to FIG. 1, it can be seen that the cylindrical side walls 202 are adapted to substantially correspond to the interior cylindrical side walls 162 of the chamber 160 and the bottom 204 is adapted to substantially correspond to the interior bottom surface 164 of the chamber. Furthermore, the top inclined surface 206 is adapted to have a portion 206A positioned above the nozzle opening 170 and portion 206B positioned substantially below or in close proximity with the nozzle opening, thereby facilitating substantial emptying of the cooled liquid from the cooler without tipping the cooler. When the interior 200 is filled with a coolant, a portion of said coolant is located above the nozzle opening and a portion of said coolant is located below the nozzle opening while retained within the bottom portion of the liquid dispenser. The side and/or bottom walls may be fabricated to provide an interference fit when the insert is inserted into the liquid dispenser, thereby removably retaining the insert at the interior bottom portion of the liquid dispenser.

FIG. 2 also shows that the top surface 206 includes perturbations 208 to facilitate the transfer of heat between the fluid and said heat storage means contained in the interior 200 thereby either cooling or heating the fluid depending. The perturbations 208 are comprised of a ribbed surface.

FIG. 2 also shows that the insert includes an optional retainer of at least one suction cup 210 located at the bottom 204 of the insert for retaining the insert within the liquid dispenser by affixing the retainer to a bottom surface of the liquid dispenser.

FIG. 2 also shows a sealing means 212 located along the side walls 202 for forming an interference fit with interior side walls 162 of the chamber, thereby providing a retainer for retainer the insert within the chamber. The sealing means 212 also substantially prevents fluid from flowing below in the area below the insert. The sealing means 212 is preferably an O-ring affixed to the insert in a manner known to those familiar with the art.

FIG. 2 also shows a handle 214 for facilitating installation and removal of the insert 100 from the interior chamber 160 of the liquid dispenser 150. The handle 214 is preferably integrally molded into the insert.

FIG. 2 also shows that the top inclined surface 206 includes an interlocking adapted to interlock with the top inclined surface of a second insert, thereby facilitating the interlocked stacking of multiple inserts. The interlock is shown as a tab 220 and a slot 222. Other interlocks known to those familiar with the art are also anticipated.

FIG. 2 also shows a resealable access port 230 facilitating removal and installation of the heat storage means. For example, if the heat storage means is water or ice, the top of the access port can be removed, old water removed and fresh/clean water installed. Thereafter, the insert is frozen in a freezer and then inserted into the liquid dispenser for cooling the fluid therein. Alternately, ice cubes may be installed in the interior 200 through access port 230 thereby eliminating any need to freeze the insert. Thus, the insert includes a removable heat sink material for transferring heat from said heat sink material to a refrigeration means prior to placement of the insert within the liquid cooler and for transferring heat to said heat sink material from the fluid while placed within the liquid dispenser, thereby cooling the fluid within the liquid dispenser. Also note that other means for installing and removing heat sink material known to those familiar with the art are also anticipated.

Figure 3:
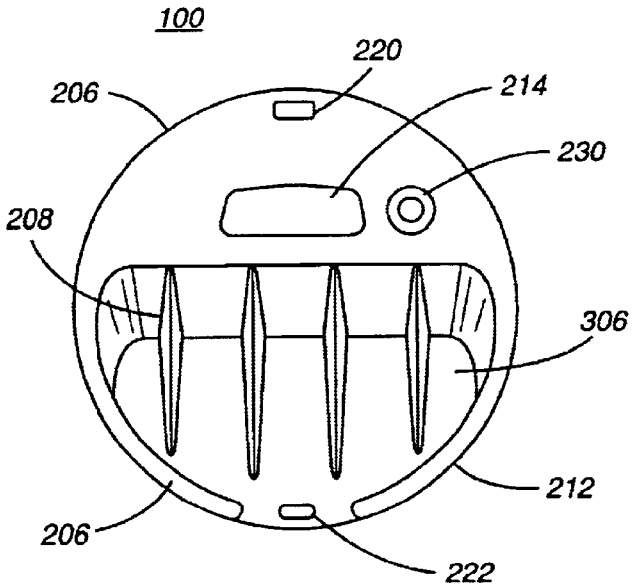
FIG. 3 shows a top view of the cool insert.

FIG. 3 shows a top view of the cool insert. Note that a second inclined top surface 306 is visible from the top view. Some fluids used for drinking may contain undesirable sediment. It is therefore desirable to prohibit the sediment from exiting the fluid dispenser through the nozzle. The insert 100 includes ridges or an abrasive surface or other form of sediment trapping known to those familiar with the art on the top surfaces 206 and 306. The effectiveness of the sediment trap is further enhanced by the insert's elimination of the need for tipping the drink dispenser in order to dispense the final amount of fluid from the nozzle.

Figure 4:
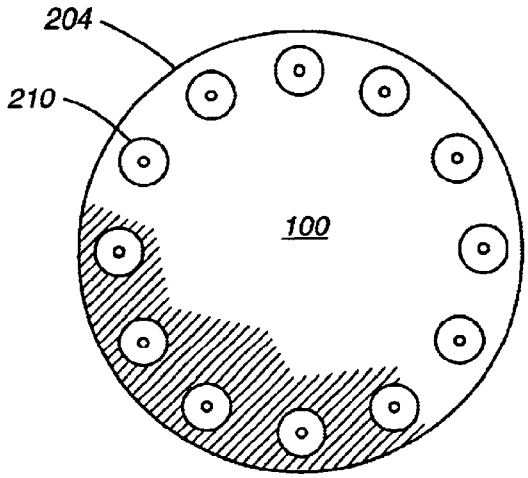
FIG. 4 shows a bottom view of the cool insert.

FIG. 4 shows a bottom view of the cool insert. The bottom 204 is shown having a plurality of suction cups 210 for retaining the insert in the bottom of the drink dispenser.

Figure 5:
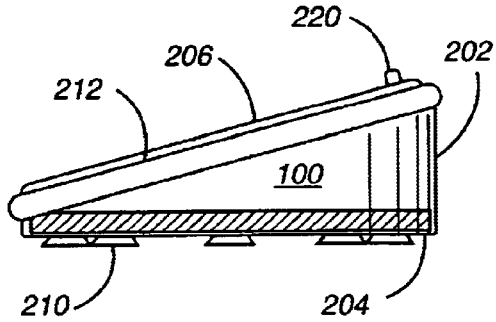
FIG. 5 shows a side view of the cool insert.

FIG. 5 shows a side view of the cool insert.

Figure 6:
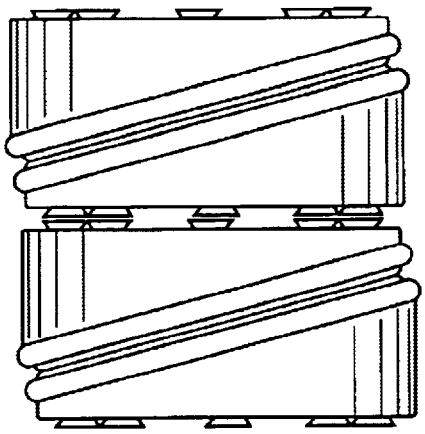
FIG. 6 shows a stack of four cool inserts.

FIG. 6 shows a stack of four cool inserts. Note that when one cool insert is inverted and it's top surface mated to the top surface of another cool insert, the bottoms of each of the cool inserts are parallel. This facilitates stacking of a number of cool inserts within a refrigerator or freezer prior to installation in a drink dispenser. Further note that the top surfaces of the inserts interlock. That is that tab 220 fits into slot 222 of the corresponding insert. Since the upper and lower surfaces of a pair of interlocked inserts are parallel, numerous pairs of inserts may be stacked. Note that an alternate embodiment may have the optional suction cups removed to better facilitate stacking. It should be further appreciated that multiple pairs of interlocked inserts may stacked for transportation within an empty insulated drink dispenser. After arriving at a destination, the multiple stacked inserts may be removed from the transport drink cooler and installed in several coolers at the destination. Thus, the transport cooler not only insulates multiple inserts during transport but also serves as a drink dispenser with an insert at the destination. It should be appreciated that removal of the optional O-ring 212 may ease removal of the interlocked inserts from the transport drink dispenser.

Figure 7:
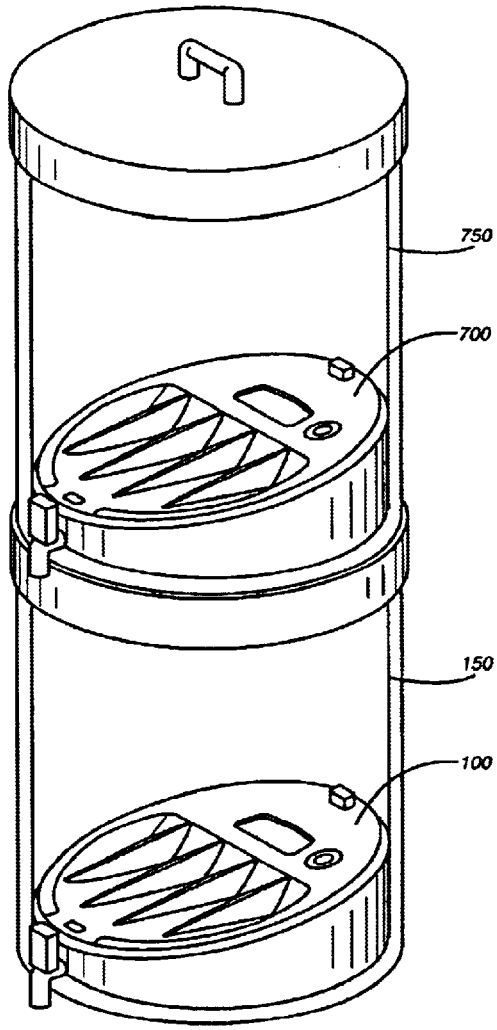
FIG. 7 shows a stack of liquid dispensers having cool inserts therein.

FIG. 7 shows a stack of liquid dispensers having cool inserts therein. A first liquid dispenser 150 dispenses fluid from a nozzle located at the bottom of the first liquid dispenser. An insert 100 cools the liquid drink and dispenses substantially all of the drink through the nozzle without tipping the first liquid drink cooler. The top of the first liquid dispenser is substantially flat, when the optional handle is folded down and is thus adapted for facilitating stacking a second liquid dispenser 750 on top of said first liquid dispenser 150 thereby providing for dispensing of liquid drink from the stacked first and second coolers without tipping the first cooler to empty liquid drink from the first cooler. The second cooler 750 may also have its own insert 700. The top of a drink dispenser may interlock with the bottom of another drink dispenser using corresponding ridges, taps and slots or there interlock means known to those familiar with the art to yield an adapter that provides for an interlock between said first liquid dispenser 150 and the second liquid dispenser 750. It should be further appreciated that the elimination of the requirement of tipping the drink cooler also has advantageous applications when the drink dispenser is relatively fixed, such as to the back of a truck at a construction or other labor site.

Thus, the invention advantageously provides for dispensing of a cool drink without the need to add ice. Since ice floats to the top of the fluid, the fluid at the bottom of the container is not well cooled. However, since the insert is retained at the bottom of dispenser close to the nozzle, and since chilled liquid tends to stay at the bottom of the drink dispenser, the chilling of the dispensed liquid is substantially enhanced. Furthermore, as the ice melts, the fluid is diluted thereby changing the flavor and reducing any medicinal effect resulting from drinking the fluid, particularly towards the final liquid dispensed by the drink dispenser. However the insert can eliminate the need for adding ice, thereby eliminating any dilution of the drink. Furthermore, the insert is shaped to eliminate the need to tip the dispenser in order to dispense the last of the remaining fluid from the nozzle of the dispenser. Elimination of the requirement of tipping the dispenser makes it allows for the stacking of dispensers and enhances use of dispensers when affixed to a relatively stationary object.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention. For example, while the preferred embodiment is a fluid cooler, alternate embodiments could produce fluid heaters by heating rather than cooling the insert prior to exposure to the fluid. Also, corresponding sidewalls 162 and 202 are shown as cylindrical, other shapes, sizes and capacities are also anticipated.

We claim:

1. A cool insert according for a portable liquid dispenser comprising:

a retainer for removably retaining the cool insert at an interior bottom portion of the liquid dispenser; and a coolant for cooling a fluid substantially at the bottom of the liquid dispenser;

wherein the liquid dispenser has an interior bottom surface and a nozzle opening located there above and the cool insert has an top inclined surface adapted such that a portion of said coolant is located above the nozzle opening and a portion of said coolant is located below the nozzle opening while retained within the interior bottom portion of the liquid dispenser.

2. The cool insert according to claim 1 wherein said top inclined surface is includes an interlock adapted to interlock with a the top inclined surface of a second insert when the second insert is inverted and stored atop the cool insert, thereby facilitating secure stacked storage of multiple inserts.

3. An insert for a liquid dispenser comprising:

a retainer for retaining the insert at an interior bottom portion of the liquid dispenser; and a heat storage means for substantially modifying the temperature of a fluid contained within the liquid dispenser wherein the liquid dispenser includes a chamber comprised of interior side walls and an interior bottom surface, and a nozzle opening located substantially at the bottom of the chamber for dispensing the liquid through a nozzle and the insert further comprises a housing having:

side walls adapted to substantially correspond to the interior side walls of the chamber;

a bottom adapted to substantially correspond to the interior bottom surface of the chamber; and a top inclined surface adapted to have a portion positioned above the nozzle opening and a portion positioned substantially below or in close proximity with the nozzle opening, thereby facilitating substantial emptying of the fluid from the liquid dispenser without tipping the liquid dispenser.

4. The insert according to claim 3 wherein the top surface includes perturbations to facilitate the transfer of heat between the fluid and said heat storage means.

5. The insert according to claim 4 wherein said perturbations are comprised of a ribbed surface.

6. The insert according to claim 3 wherein said retainer includes an interference fit between the side walls of the insert and the interior side walls of the chamber.

7. The insert according to claim 3 wherein said retainer includes a sealing means located along said side walls for forming an interference fit with the interior side walls of the chamber and for substantially preventing fluid from flowing there below.

8. The insert according to claim 3 further comprising a bottom wherein said retainer further includes at least one suction cup located at said bottom of said retainer for retaining the insert within the liquid dispenser by affixing said retainer to a bottom surface of the liquid dispenser.

9. The insert according to claim 3 further comprising a handle for facilitating removal of the insert from the liquid dispenser.

10. The insert according to claim 3 wherein said heat storage means includes a heat sink material for transferring heat from said heat sink material to a refrigeration means prior to placement of the insert within the liquid cooler and for transferring heat to said heat sink material from the fluid while placed within the liquid dispenser, thereby cooling the fluid within the liquid dispenser.

11. The insert according to claim 10 wherein said heat sink material comprises water, ice or a gel adapted to enhance the heat storage capacity of said heat sink means.

12. The insert according to claim 10 wherein the liquid dispenser includes a chamber comprised of interior side walls and an interior bottom surface, and a nozzle opening located substantially at the bottom of the chamber for dispensing the liquid through a nozzle and the insert further comprises a housing including:

side walls adapted to substantially correspond to the interior side walls of the chamber;

a bottom adapted to substantially correspond to the interior bottom surface of the chamber; and a top inclined surface adapted to have a portion positioned above the nozzle opening and a portion positioned substantially below or in close proximity with the nozzle opening, thereby facilitating substantial emptying of the fluid from the liquid dispenser without tipping the liquid dispenser.

13. The insert according to claim 12 wherein the top inclined surface is adapted to interface with the top inclined surface of a second cooler insert to facilitate stacking of a plurality of cooler inserts, thereby facilitating efficient storage while the plurality of insert coolers are stored within the refrigeration means.

14. The cool insert according to claim 3 wherein said top inclined surface is includes an interlock adapted to interlock with a the top inclined surface of a second insert when the second insert is inverted and stored atop the cool insert, thereby facilitating secure stacked storage of multiple inserts.

* * * * *